United States Patent [19]

Sanburg

[11] Patent Number: 4,671,203

[45] Date of Patent: Jun. 9, 1987

[54] BOAT SUPPORTED DUCK BLIND

[76] Inventor: Larry E. Sanburg, P.O. Box 69, Manson, Iowa 50563

[21] Appl. No.: 827,505

[22] Filed: Feb. 10, 1986

[51] Int. Cl.[4] ..... B63B 17/00

[52] U.S. Cl. ..... 114/361; 114/343; 114/351; 135/88; 135/117; 135/901

[58] Field of Search ..... 114/351, 361, 343, 364, 114/71; 135/901, DIG. 9, 88, 96, 102, 113, 117, 119

[56] References Cited

U.S. PATENT DOCUMENTS

| | | | |
|---|---|---|---|
| 739,389 | 9/1903 | Castle | 114/361 |
| 2,889,839 | 6/1959 | Sheridan | 114/361 |
| 4,070,722 | 1/1978 | Sutherland | 114/351 |
| 4,106,145 | 8/1978 | Gillen | 114/351 |
| 4,300,253 | 11/1981 | Anderson | 114/361 |
| 4,593,641 | 6/1986 | Adams et al. | 114/351 X |

*Primary Examiner*—Joseph F. Peters, Jr.
*Assistant Examiner*—Paul E. Salmon
*Attorney, Agent, or Firm*—Morton S. Adler

[57] ABSTRACT

A duck blind adapted for mounting on the gunwales of a boat hull includes separate bow, stern and central frame sections adapted for use on various size boats. Camouflage designed cover sections with windows are provided for each frame section and are removably connected by zippers to provide a cover over the entire boat. Desired access points or shooting stations from the boat to the outside are obtained by the stragetically arrangement of zippered fasteners. A reticulated camouflage type curtain is arranged inside the cover sections to provide concealment for the hunter when designated cover sections are unzippered. A separate zippered section in the central cover provides ingress and egress for the hunter's dog and the reticulated curtain can be arranged by appropriate zippering to provide an enclosure about the dog's station within the boat to protect the hunter from the water spray when the dog returns to the boat from the water and shakes itself off. The frame sections are of a knockdown construction for ease of handling and storage and are adjustable to provide a fully erected cover, an open bow or stern section of the boat, separately or simultaneously, a tarp-type closure for the bow or stern section of the boat, separately or simultaneously, a full open boat with the cover sections folded down and a tarp-like enclosure for the entire boat for storage or trailering. The boat can be trailered with the cover fully erected for which an auxiliary bow cover support is provided.

17 Claims, 18 Drawing Figures

FIG. 1
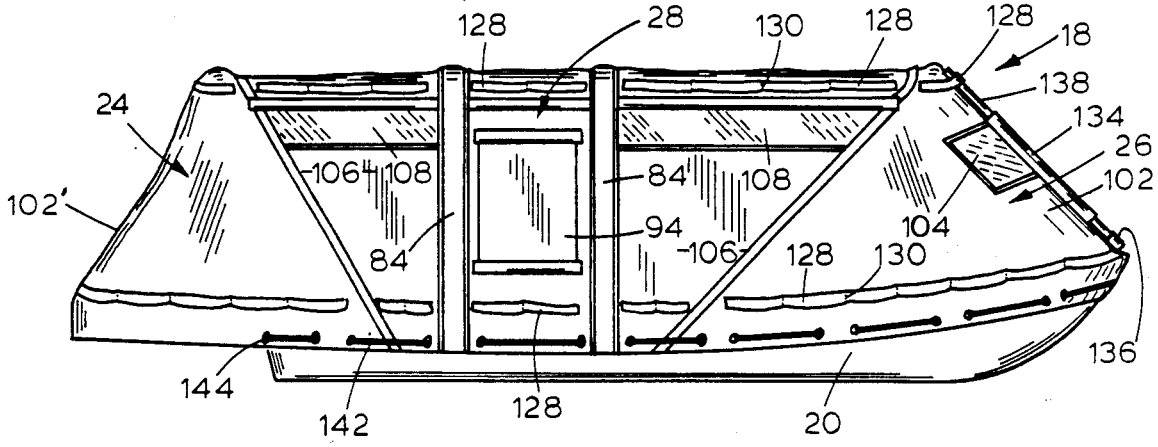
FIG. 3
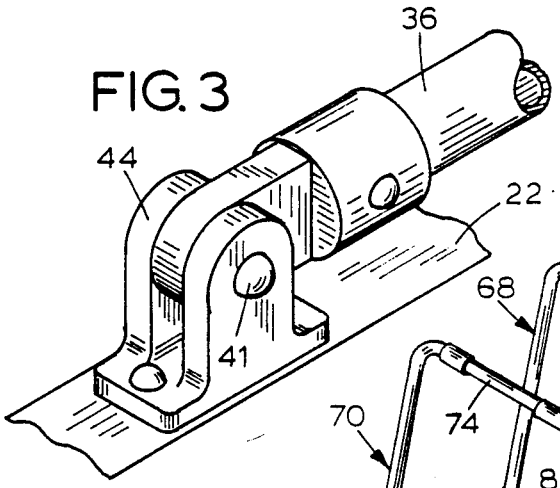
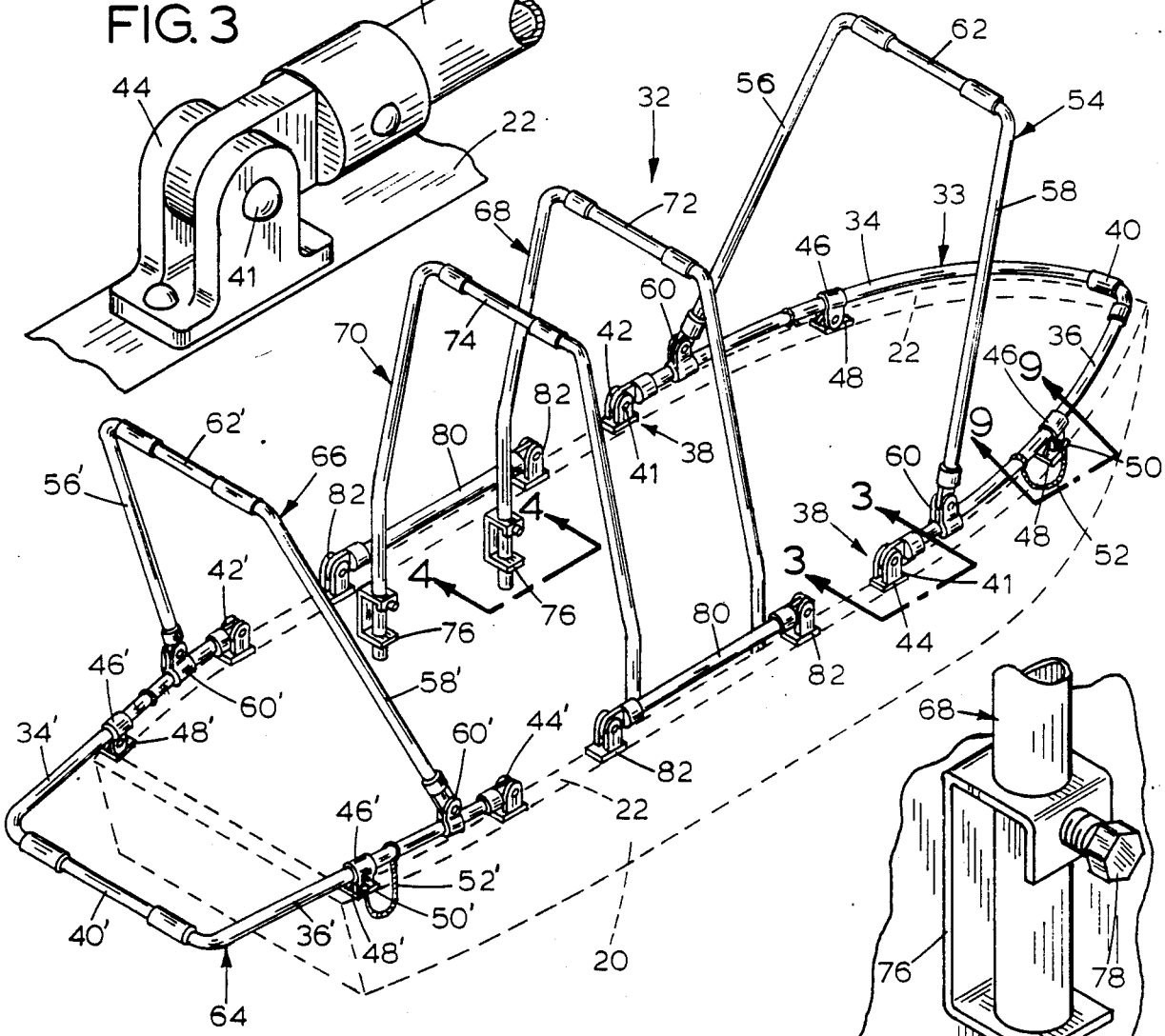
FIG. 2
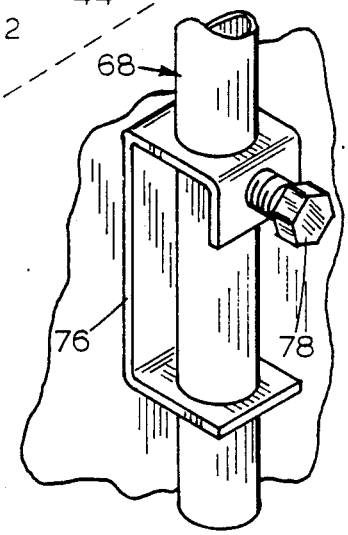
FIG. 4

FIG. 5
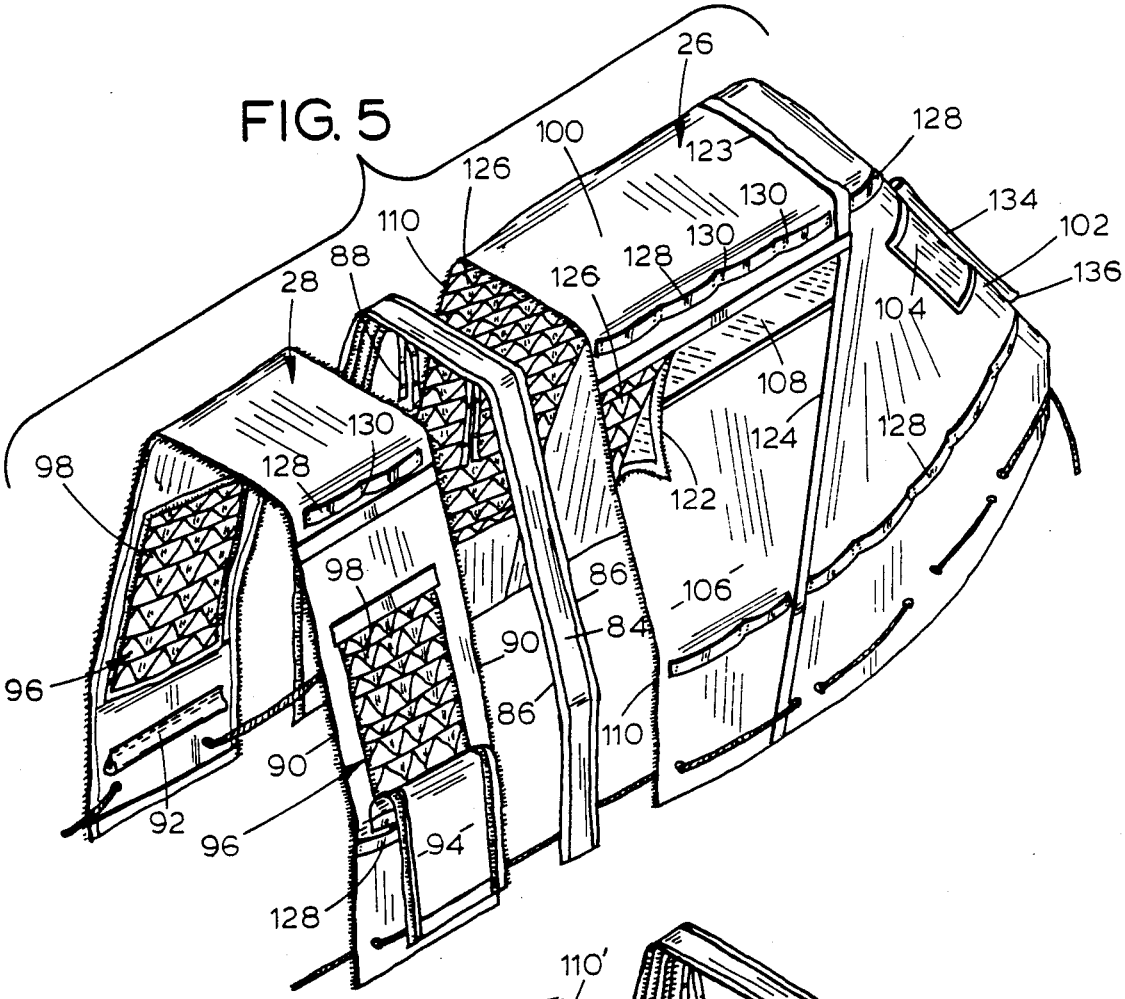
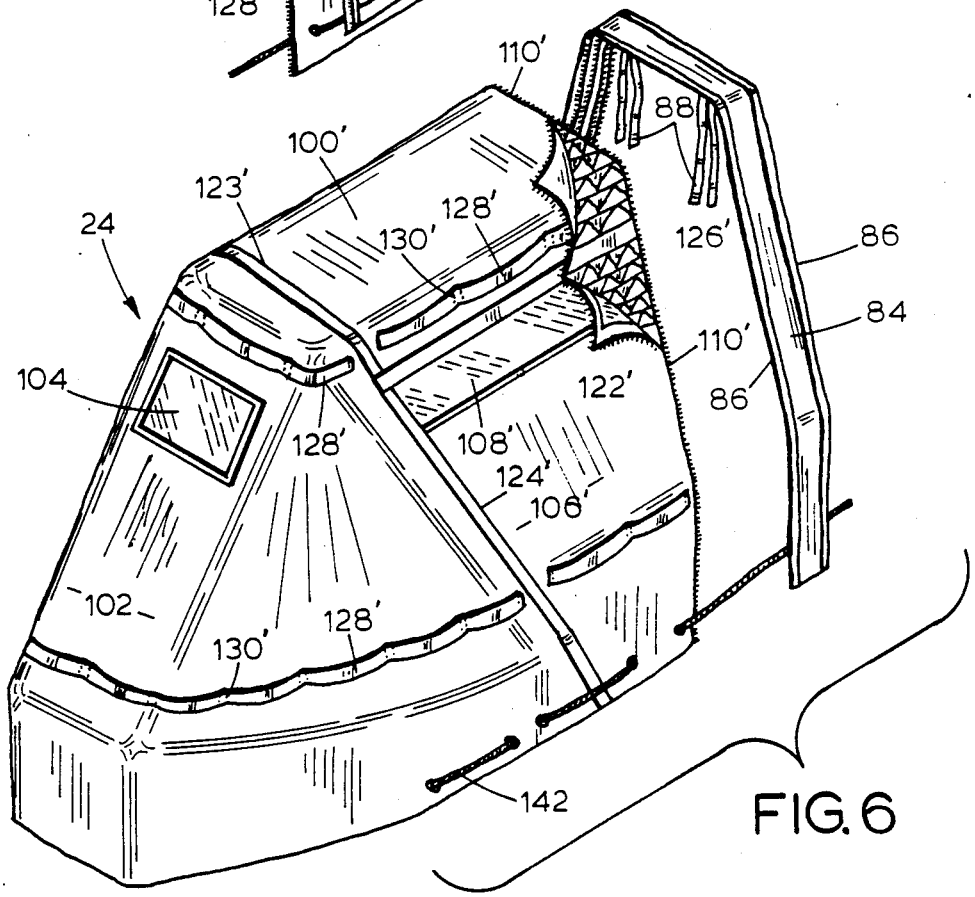
FIG. 6

BOAT SUPPORTED DUCK BLIND

BACKGROUND OF THE INVENTION

This invention relates to a duck blind adapted for mounting on the gunwales of a boat.

Duck blinds of this type have long been known and used by duck hunters and while those as presently used include such common elements as a camouflage cover, shooting ports and in some cases a station for the hunter's dog, their design features have certain limitations for the intended use and they are lacking in the capability for adjustment to accommodate a versalitity of uses and purposes that are desirable in an item of this type.

SUMMARY

With the above observations in mind, it is one of the important objects of this invention to provide a boat supported duck blind that includes improved and novel design features that permit a variety of adjustments and arrangements for versalitity of use in varying conditions which the hunter may encounter.

More particularly, it is an object herein to provide a duck blind as characterized which has improved sectionalized frame sections for supporting a plurality of attached cover sections with windows that can be easily and quickly assembled or dismantled and which is adapted for trailering in erected position, if desired.

A further object is to provide this duck blind with an auxiliary removable bow cover support when erected and being trailered.

Another feature of this invention is to provide an interior camouflage curtain to conceal the hunter when the outer camouflage cover is in open position.

A further object is to provide a duck blind of the above class adapted to create an optional station for the hunter's dog and including curtain means for enclosing such station to intercept water spray when the dog returns to the boat from the water and shakes itself off.

A further feature is to provide improvements for securing an open cover section at a shooting port against flapping in the wind or otherwise interferring with the hunter.

Still other objects of this invention are to provide a duck blind as characterized that is capable of a wide range of adjustments to expose or cover selected areas of the boat separately and simultaneously and that is extremely efficient and easy to use.

In accordance with the present invention, a duck blind adapted for mounting on the gunwales of a boat hull includes separate bow, stern and central frame sections adapted for use on various size boats. Camouflage designed cover sections with windows are provided for each frame section and are removably connected by zippers to provide a cover over the entire boat. Desired access points or shooting stations from the boat to the outside are obtained by the stragetically arrangement of zippered fasteners. A reticulated camouflage type curtain is arranged inside the cover sections to provide concealment for the hunter when the designated cover sections are unzippered. A separate zippered section in the central cover provides ingress and egress for the hunter's dog and the reticulared curtain can be arranged by appropriate zippering to provide an enclosure about the dog's station within the boat to protect the hunter from the water spray when the returns to the boat from the water and shakes itself off. The frame sections are of a knockdown construction for ease of handling and storage and are adjustable to provide a fully erected cover, an open bow or stern section of the boat, separately or simultaneously, a tarp-like closure for the bow or stern section of the boat, separately or simultaneously, a full open boat with the cover sections folded down and a tarp-like enclosure for the entire boat for storage or trailering. The boat can be trailered with the cover fully erected for which an auxiliary bow cover support is provided.

The foregoing objects and such further objects as may appear herein, or be hereinafter pointed out, together with the advantages of this invention will be more fully discussed and developed in the more detailed description of the accompanying drawings.

BRIEF DESCRIPTION OF THE DRAWINGS

FIG. 1 is a side view of a duck blind on a boat in erected position according to this invention, FIG. 2 is an enlarged perspective view of the several frame sections of this invention shown mounted on a boat that is illustrated in phantom, FIG. 3 is an enlarged perspective view of a trunnion support for the bow and stern frames taken from the line 3—3 of FIG. 2, FIG. 4 is an enlarged perspective view of a support bracket for the central frame taken on the 4—4 of FIG. 2, FIG. 5 is an enlarged exploded perspective view of the bow and center cover sections of this invention, FIG. 6 is similar to FIG. 5 relative to the stern and central cover section.

DESCRIPTION OF THE PREFERRED EMBODIMENTS

Figure 7:
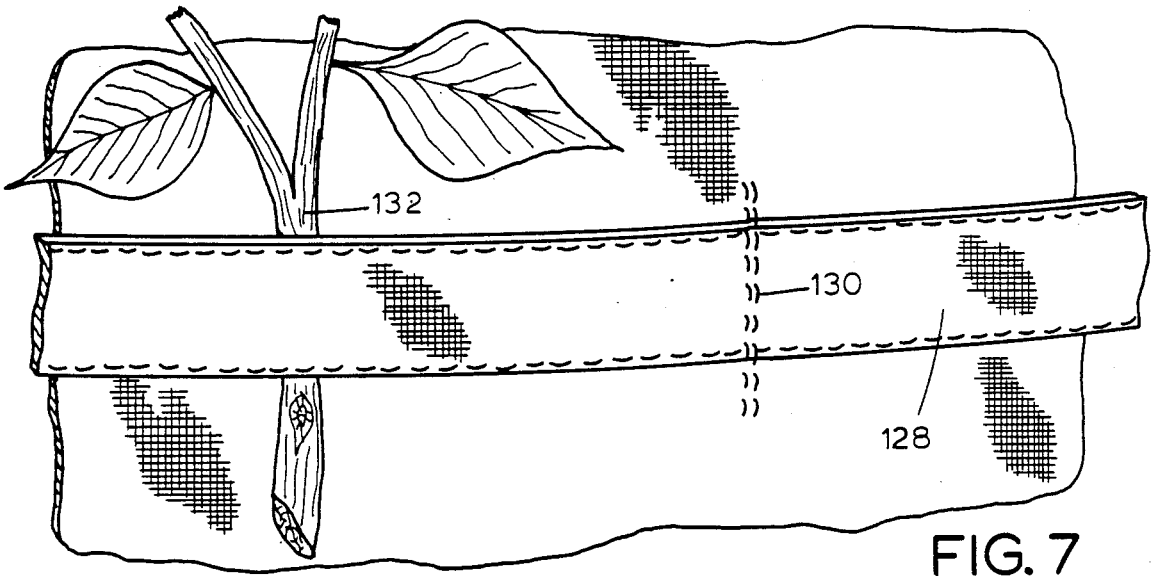
FIG. 7 is an enlarged fragmentary elevational view of a cover section to show the outer strap adapted to support a twig, foilage or the like, FIG. 8 is an enlarged perspective view of the stern cover showing a portion opened downwardly from its top portion to form a shooting port; showing the interior curtain depending from the top and showing the top portion folded under against itself and into a storage compartment formed by the interior curtain and a portion of the top portion.

Referring to the drawings, this new duck blind is designated generally by the numeral 18 and is shown in erected position in FIG. 1 on an open boat 20 having the gunwales 22.

As seen in FIG. 1, blind 18 comprises a flexible cover of plastic, canvas or the like with any suitable camouflage design appearance and is formed by a plurality of sections removably secured together by zippers to provide generally the stern section 24, the bow secton 26 and the center section 28 which all will be referred to in more detail.

Figure 9:
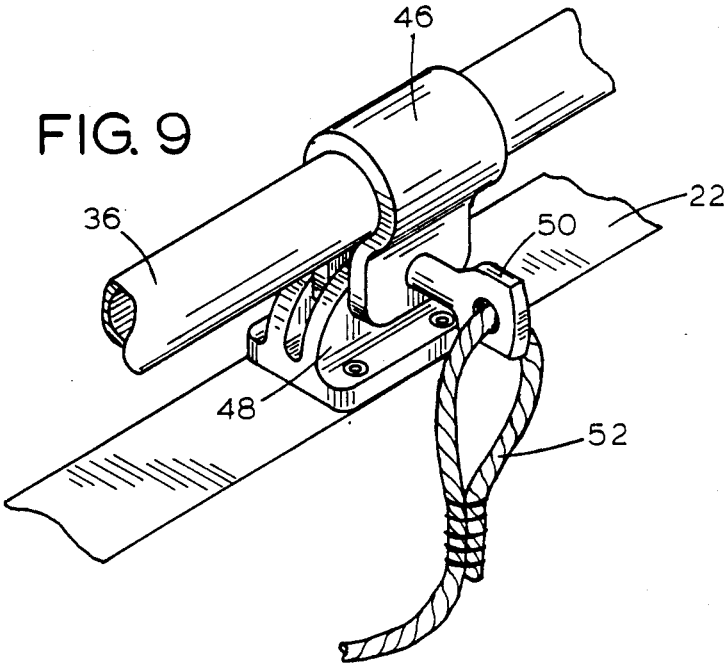
FIG. 9 is an enlarged perspective view of the releasable hold down bracket on the bow and stern frames taken on the line 9—9 of FIG. 2.
Figure 10:
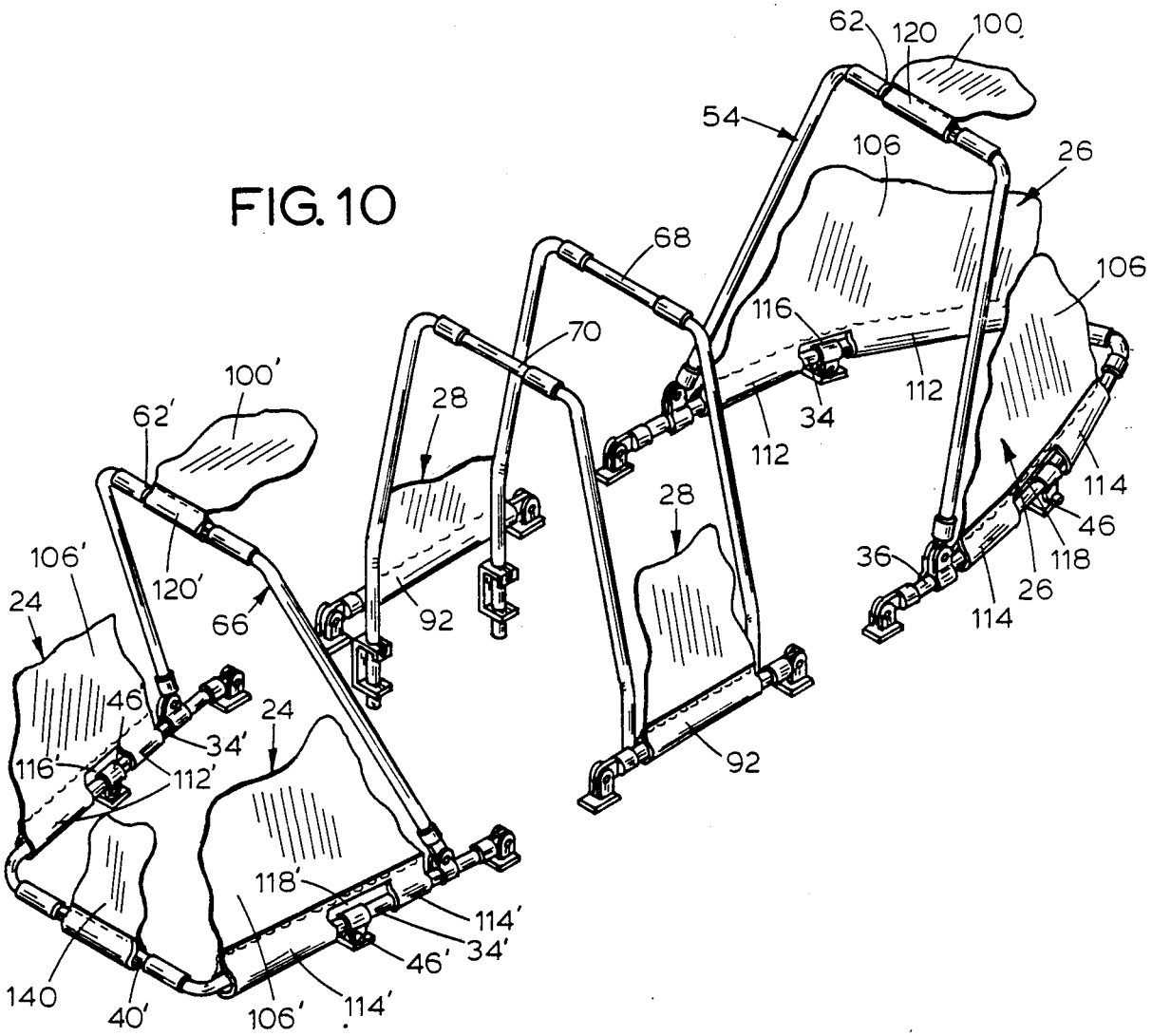
FIG. 10 is an enlarged perspective view of the frame sections similar to FIG. 2 showing fragmentary portions of the cover sections to illustrate the attachment of the cover sections to the frames.

The supporting frame structure for blind 18 is designated generally as 32, as best seen in FIG. 2, and is constructed as follows. At the bow end of boat 20, the bow frame section 33 is formed by a pair of tubular members 34, 36 spaced apart at one end 38 to conform to the distance between the gunwales 22 and converging at the other end on a line corresponding to the curvature of the gunwales 22 where they are removably connected by a slip-fit connector 40. At end 38, members 34, 36 are removably pivotally connected by pins 41 to respective trunnions 42, 44 that are suitably secured to gunwales 22. Intermediate ends 38 and connector 40, like apertured fittings 46 are secured respectively to members 34, 36 to register with like complementary apertured fittings 48 secured to the gunwales 22. Fittings 46, 48 are releasably securable together by a pin 50 tethered to the bow frame by a cord 52 as best seen in FIG. 9. By this arrangement, bow members 34, 36 can be locked in place at times on the gunwales 22 and this serves to hold the cover tight as will become apparent. Members 34, 36 carry the bow rib 54 as seen in FIG. 2 which comprises spaced tubular members 56, 58 pivotally secured at like ends to fittings 60 that are attached respectively to members 34, 36 and at their opposite ends are connected by the slip-fit connector bar 62 so as to form a generally inverted arcuate bow for the bow frame 33. The bow rib 54 is thus independently movable relative to members 34, 36 so as to be adjustable in supporting a cover and the slip-fit connectors 40, 62 serve to make these frame and bow sections easily separable whereby they can be handled as individual pieces with ease and stored in a minimum of space.

The stern frame section 64 is designed to project rearwardly of the stern of the boat 20 and carries the stern rib 66 similar to the bow rib 54. In general, the bow frame 33 and the stern frame 64 are of like construction and operation so that like parts have been given like numerals primed.

The center frame section preferably includes two like inverted generally arcuate members 68, 70 (FIG. 2) but may include additional members if required by the length of the boat. Members 68, 70 are formed substantially the same as ribs 54, 66 including the respective slip-fit connectors 72, 74 for the purposes described. Each member 68, 70 is removably mounted to hull mounted brackets 76 provided with a set screw 78 as shown in FIG. 4. A hold down bar 80 for the center cover section 28 is removably mounted to spaced supports 82 secured to the gunwales 22 on each side of the boat 20 exteriorily of the center frame members 68, 70.

Reference is now made more particularly to FIGS. 1, 5 6 and 8 relative to the novel construction and use of cover 18 by virtue of the separable stern 24, bow 26 and center 28 sections previously identified.

The center cover section 28 serves to connect the stern 24 and bow 26 cover sections into a complete cover and also provides for either a separate shooting station for a hunter or a station for the hunter's dog. For mounting of section 28, the center frames 68, 70 are each covered by a camouflage type fabric strap 84 so as to overlay the gunwales 22 and each edge of each strap 84 is provided with the zipper fastener 86. Straps 84 are removably secured to the top of frames 68, 70 by flexible ties 88. Cover section 28 is an elongated band of camouflage type fabric material having zipper fasteners 90 (FIG. 5) on each opposed edge for mounting intermediate frames 68, 70 by zippered engagement with zippers 86 at adjacent edges of straps 84. The extremities of cover section 28 overlap the gunwales 22 and interiorly of such extremities are fabric sleeves 92 (FIG. 5) through which the hold down bars 80 are journalled. Each side of section 28 has a zippered flap 94 for providing a shooting port 96 or an ingress and egress port for the hunter's dog and interiorly of port 96 is a zippered reticulated flexible camouflage type curtain 98 which conceals the hunter when flap 94 is open but does not restrict his view and which can be unzippered selectively at the top, bottom and sides for easy movement out of the way for shooting.

The bow cover section 26 (FIG. 5) is generally hood-like in shape defining a top 100, a downwardly inclined closed portion 102 with a vinyl window 104 for the bow of the boat 20, sides 106 with vinyl windows 108 and an open end with a zippered edge 110 disposed towards the center of the boat 20. Interiorly of sides 106 near the bottom thereof are respective fabric sleeves 112, 114 through which the respective frame tubes 34, 36 are journalled to hold cover section 26 tight and in each sleeve 112, 114 is a respective cutout area 116, 118 to accommodate the fittings 46, 48 on tubes 34, 36. A similar sleeve 120 is provided interiorly of the forward portion of cover top 100 for bar 62 of the bow rib 54. Thus far described, cover section 26 is attached to strap 84 on center frame 68 by zippering edge 110 on cover 26 to an adjacent edge 86 on strap 84 as seen in FIG. 1.

The sides 106 of cover section 26 are zippered along the top edge 122 so as to be separable from top 100 which is also zippered on edge 123. Sides 106 are also provided with the zippered edge 124 extending on a downwardly and rearwardly incline from the forward portion of top 100 as best seen in FIG. 5. Interiorly of section 26 and in juxtaposition with sides 106 and top 100 is a reticulated camouflage type flexible curtain 126 which is zippered to such sides and top along the side edges and bottom so it can be released in a variety of desired ways such as along one side or one side and the bottom, or both sides and the bottom etc. Around the sides and front of cover section 26 at the upper and lower portions thereof, and also at the sides of the center cover section 28, are straps 128 intermittently stitched as at 130 to provide means for the hunter to insert selected foilage 132 for additional camouflage purposes. Centrally on front 102 of cover section 26 is a fabric sleeve 134 extending between the bow point 136 of the cover towards but not to top 100. Sleeve 134 is closed at point end 136 and receives a removable rigid rod 138 that is journalled through sleeve 134 and under a portion of strap 128 as best seen in FIG. 1. By this arrangement, if the hunter wishes to trailer his boat with the cover erected, rod 138 provides a rigid support at the bow against the wind.

The stern cover section 24 is constructed similarly to the bow cover section 26 and has the same versatility in use except for the bow sleeve 134 and rod 138. It also has an additional rear sleeve 140 for frame end 40' and with such exceptions as noted, like parts are given like numerals primed. A tie down cord 142 reeved through spaced grommets 144 around the lower portion of the respective cover sections is provided to secure such portions to the boat in a well known manner.

Cover 18 when constructed and erected as described and as best seen in FIG. 1, will provide a shooting station in the boat at each opposed side 106 of the bow cover 26, at each of sides 106' of the stern cover 24 and at each opposed side of the center cover 28, if desired, with such center station adapted for use by the hunter's dog. The number of stations that can be provided will depend upon the size of the boat and with large boats, additional center sections can be added for such purposes or to otherwise provide an adequate cover for the length of the boat used. The bow and stern covers 26, 24 have windows 108, 108' at each shooting station and windows 104, 104' provide sighting capability through the bow and stern. In the center cover 28, flap 94 can be zippered open to any degree and if a dog station is used, such flap can be fully opened to provide easy egress and ingress.

Figure 8:
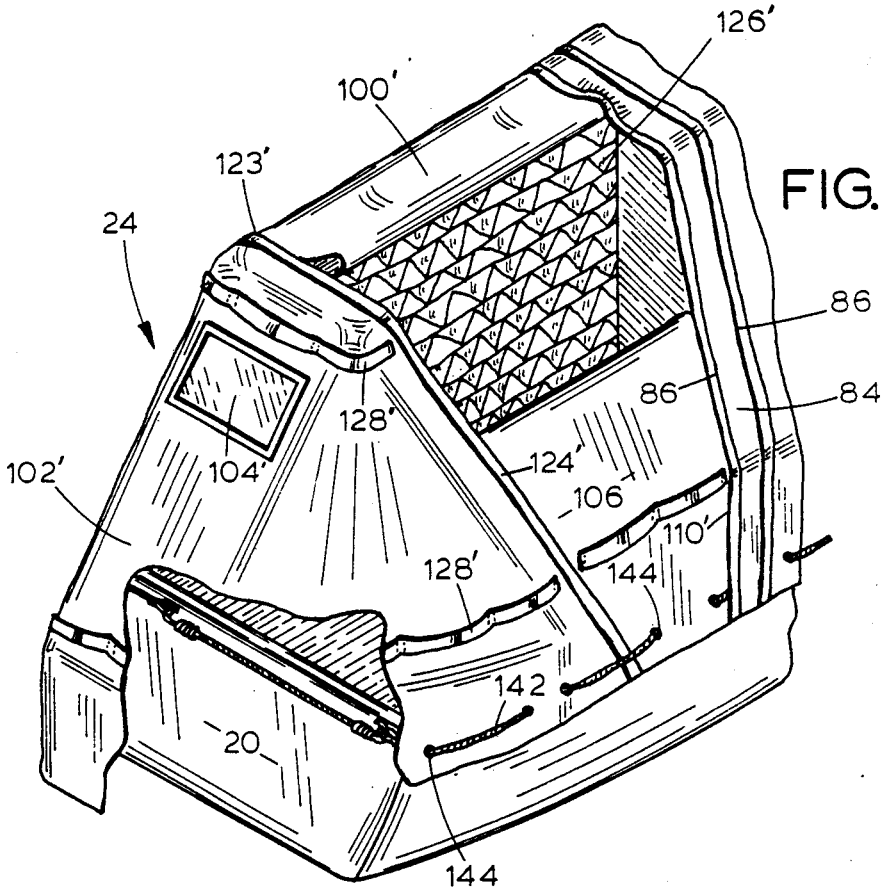
Figure 11:
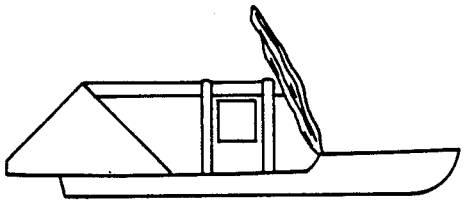
FIG. 11 is a schematic view of this invention on a boat hull showing the stern and central section erected with the bow section folded against the center section so that the bow of the boat is open.
Figure 12:
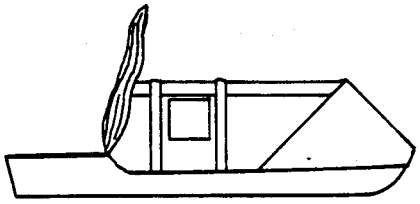
FIG. 12 is a like schematic view showing the bow and central sections erected with the stern section folded against the center section so the stern of the boat is open.
Figure 13:
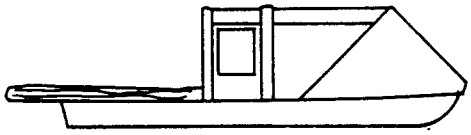
FIG. 13 is a like schematic view showing the bow and central sections erected with the stern cover down in the form of a tarp-like cover.
Figure 14:
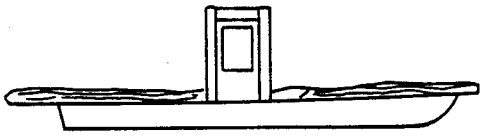
FIG. 14 is a like schematic view showing the bow and stern frames and covers down to form a tarp-like cover.
Figure 15:
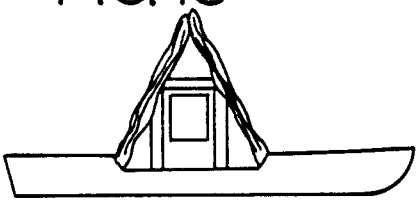
FIG. 15 is a like schematic view showing the center section erected and with both the bow and stern covers folded against the center section so that both the bow and stern of the boat are open.
Figure 16:
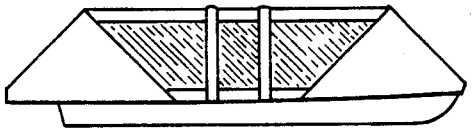
FIG. 16 is a like schematic view showing the cover erected with all side portions open and with the interior curtain depending in the formed openings.

At each shooting station, the sides of respective cover sections 24, 26 can be selectively zippered to any degree of openess as seen in FIGS. 5, 6, and 8 and when this is done, the interior reticulated curtain 126, 126' conceals the shooter and can be unzippered to any degree (FIG. 8) so as not to interfere with shooting. With cover sides 106, 106' unzippered at edges 122, 122' from top 100, 100' and top 100, 100' unzippered along edges 110, 110' and 123, 123' for purposes of more shooting room or for any other purpose, it will be appreciated that top 100, 100' would become a loose flap susceptible to movement in the wind and in comparable situations with other blinds, this is a disadvantage and annoyance. With the present cover, however, the interior curtain 126, 126' can be kept zippered partially along top 100, 100' whereby the unsecured edge of top 100, 100' can be folded under against itself and against curtain 126, 126' where it is secured against the wind as best seen in FIG. 8.

Another feature of this cover 18 is that when a dog is stationed in the center section, adjacent edges of the interior curtain 126, 126' in cover sections 26, 24 and the interior curtain 98 in the center cover 28 can be temporarily connected to form an enclosure or compartment about the dog's station to protect the hunter from a water spray when the dog returns from an excursion in the water and shakes itself off.

The sectionalized construction of cover 18 permits a wide variety of uses other than in fully erected position and these are illustrated schematically in FIGS. 11–18 which are apparent from inspection and which were particularly identified in the prior description of such Figures. In this regard with reference to FIGS. 11, 12 and 15 particularly, it will be understood that pin 50 is removed where required to release a respective bow or stern frame from its secured position on the gunwales 22.

Figure 17:
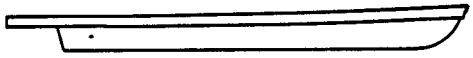
FIG. 17 is a like schematic view showing the frames removed and the cover positioned to serve as a tarp for travel or storage.
Figure 18:
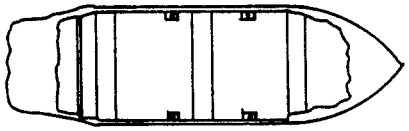
FIG. 18 is a like schematic view showing the center frame and cover removed with the bow and stern covers folded down to provide a full open boat.

The cover construction described provides a secure and tight enclosure when erected; can be easily dismantled with the frame sections removable into easily handled and storable sections; can be trailered either fully erected or reduced to a tarp-like cover as seen in FIG. 17 and has the versalitity for use in the several ways described. Accordingly, in view of the foregoing, it is thought a full understanding of the construction and operation of this invention will be had and the advantages of the same will be appreciated.

I claim:

1. A duck blind adapted to be supported on the gunwales of an open boat defining a bow section, a stern section and a central section, said duck blind comprising:

a central frame including a pair of spaced arcuate central ribs, means for releasably mounting said central ribs in a fixed upstanding position to said central section, an arcuate bow frame removably pivotally secured to said gunwales at said bow section so as to be movable from and to positions in juxtaposition with said gunwales and in abutment with one of said central ribs, an arcuate stern frame removably pivotally secured to said gunwales at said stern section so as to be movable from and to positions in juxtaposition with said gunwales and in abutment with another of said central ribs, respective complementary fastening means on said bow and stern frames and said gunwales for releasably securing said frames at times in juxtaposition with said gunwales against movement relative thereto, respective flexible bow, stern and central cover sections adapted to embrace the respective bow, stern and central frames with means for releasably securing said cover sections thereto, zippered means on each respective cover section for releasably securing said sections together to form a complete erected covering for said boat, windows in each of said respective cover sections, said respective cover sections adapted to be selectively unzippered to provide selective shooting ports, said respective cover sections adapted to be selectively unzippered separately and simultaneously to provide a tarp-like cover at the bow and stern sections of the boat, said bow and stern frames with attached covers selectively movable separately and simultaneously when said complementary fastening means are released into abutment with a respective central rib to provide open bow and stern section of the boat, said bow and stern cover sections each defining a top and sides, said bow and stern cover sections each having a zippered edge intermediate said respective top and sides which can be selectively unzippered to provide additional shooting ports, a respective reticulated curtain zippered to the underside of said respective top and sides in juxtaposition therewith, and with a side unzipped, said reticulated curtain being unzippered from said side to depend from said top whereby said reticulated curtain is positioned to conceal any occupant of the boat but can be quickly moved for shooting purposes.

2. A duck blind as defined in claim 1 wherein the depending position of said reticulated curtain defines a compartment formed by said top and the unzippered portion of said reticulated curtain into which said unzippered top edge portion can be stored.

3. A duck blind as defined in claim 1 including a separate zippered flap in said central cover openable to provide egresss and ingress for a hunter's dog.

4. A duck blind as defined in claim 3 including said reticulated curtains being selectively connectible to provide an interior compartment for the hunter's dog in registration with said zippered flap to protect the boat occupants from a water spray when the dog returns to the boat from the water and shakes itself off.

5. A duck blind as defined in claim 1 including:

a centrally disposed longitudinal fabric sleeve on said bow cover, and a rigid rod removably journalled in said sleeve to support said cover against wind pressure when said cover is in erected position and said boat is being trailered.

6. A duck blind as defined in claim 1 including said bow, stern and central frames each provided with a removable slip-fit connecting member forming its respective bight area thereof whereby each of said frame sections can be easily and quickly assembled and dismantled into a plurality of single length components for storage in a minimum of space.

7. A duck blind as defined in claim 1 including:

said complementary fastening means on said bow and stern frames comprising:

apertured registering fittings on said respective frames and corresponding gunwales, and respective keys tethered to said gunwales for selectively locking and releasing said frames from movement relative to said gunwales.

8. A duck blind as defined in claim 1 including:

said bow, stern and central cover sections provided with selectively placed interior fabric sleeves, said respective bow and stern frames journalled through the respective sleeves on said bow and stern cover sections for holding said cover sections tight, and respective hold down rods horizontally oppositely removably disposed on said gunwales at said central section for journalling through said sleeves on said central cover section to hold the same tight.

9. A duck blind adapted to be supported on the gunwales of an open boat defining a bow section, a stern section and a central section, said duck blind comprising:

an inverted generally U-shaped bow frame for said bow section conforming to the configuration of the gunwales at said bow section and including an inverted generally U-shaped bow rib pivotally connected at its respective open ends to the respective open end portions of said bow frame, the open ends of said bow frame removably pivotally connected to opposed points of said gunwale at said bow section adjacent one side of said central section, complementary fastening means on said bow frame and said gunwales for releasably securing said bow frame at times in juxtaposition with said gunwales against movement relative thereto, an inverted generally U-shaped stern frame for said stern section and including an inverted generally U-shaped stern rib pivotally connected at its respective open ends to the respective open end portions of said stern frame, the open ends of said stern frame removably pivotally connected to opposed points of said gunwale at said stern section adjacent the opposite side of said central section, complementary fastening means on said stern frame and said gunwales for releasably securing said stern frame at times in juxtaposition with said gunwales against movement relative thereto, a pair of spaced inverted generally U-shaped central ribs defining a central section frame, opposed bracket means on said gunwales for supporting said central ribs intermediate said bow and stern sections in a fixed upstanding position, means for releasably securing said central ribs to said brackets, respective fabric straps with opposed zippered edges removably secured longitudinally over said central ribs, a hood-like bow cover adapted for removably attachment to said bow frame and having a zippered edge for removable attachment to one zippered edge of one of said straps, a hood-like stern cover adapted for removable attachment to said stern frame and having a zippered edge for removable attachment to the zippered edge of another of said straps, a central cover defining a band of fabric disposed intermediate said central ribs and having opposed zippered edges for removable attachment to respective zippered edges of said straps, windows in each of the respective bow, stern and central covers, means for releasably securing said covers tightly about the hull of the boat, said respective covers adapted to be selectively unzippered to provide desired shooting ports, said bow and stern covers adapted to be selectively unzippered separately and simultaneously to provide selectively for a tarp-like cover at the bow and stern sections of the boat, and said bow and stern frames with attached covers selectively movable separately and simultaneously when said complementary fastening means are released into abutment with a respective central rib to provide an open bow and stern section of said boat.

10. A duck blind as defined in claim 9 including:

said bow and stern covers each defining a top and sides, said bow and stern covers each having a zippered edge intermediate said respective top and sides which can be selectively unzippered to provide additional shooting ports, a respective reticulated curtain zippered to the underside of said respective top and sides in juxtaposition therewith, and with a side unzipped, said reticulated curtain being unzippered from said side to depend from said top whereby said reticulated curtain is positioned to conceal any occupant of the boat but can be quickly moved for shooting purposes.

11. A duck blind as defined in claim 10 wherein the depending position of said reticulated curtain defines a compartment formed by said top and the unzippered portion of said reticulated curtain into which said unzippered top edge portion an be stored.

12. A duck blind as defined in claim 9 including a separate zippered flap in said central cover openable to provide an egress and ingress point for the hunter's dog.

13. A duck blind as defined in claim 12 including:

a respective reticulated curtain zippered to the underside of the respective top and sides of said bow and stern covers, and said reticulated curtains being selectively connectible to provide an interior compartment in registration with said zippered flap for the hunter's dog to protect the boat occupants from a water spray when the dog returns to the boat from the water and shakes itself off.

14. A duck blind as defined in claim 9 including:

a centrally disposed longitudinal fabric sleeve on said bow cover, and a rigid rod removably journalled in said sleeve to support said cover against wind pressure when said cover is in erected position and said boat is being trailered.

15. A duck blind as defined in claim 9 including said bow and stern frames, said bow and stern ribs and said central ribs each provided with a removably slip-fit connecting member forming its respective bight area whereby each of said frame sections and ribs can be easily and quickly assembled and dismantled into a plurality of generally single length components for storage in a minimum of space.

16. A duck blind as defined in claim 9 including:

said complementary fastening means on said bow and stern frames comprising:

apertured registered fittings on said respective frames and corresponding gunwales, and respective keys tethered to said gunwales for selectively locking and releasing said frames from movement relative to said gunwales.

17. A duck blind as defined in claim 9 including:

said bow, stern and central cover sections provided with selectively placed interior fabric sleeves, said respective bow and stern frames and said bow, stern and central ribs journalled through the respective sleeves in said cover sections for holding said cover sections tight, and respective hold down rods horizontally oppositely removably disposed on said gunwales at said central section for journally through said sleeves on said central cover section to hold the same tight.

* * * * *